US007249715B1

(12) United States Patent
Lambright

(10) Patent No.: US 7,249,715 B1
(45) Date of Patent: Jul. 31, 2007

(54) KEY RING CARD WALLET

(76) Inventor: Bradley Leonard Lambright, 106 Chatham Woods Dr., Cary, NC (US) 27511

( * ) Notice: Subject to any disclaimer, the term of this patent is extended or adjusted under 35 U.S.C. 154(b) by 0 days.

(21) Appl. No.: 11/162,459

(22) Filed: Sep. 10, 2005

Related U.S. Application Data

(63) Continuation of application No. 10/336,947, filed on Jan. 6, 2003, now abandoned.

(60) Provisional application No. 60/348,058, filed on Jan. 11, 2002.

(51) Int. Cl.
*G06K 19/00* (2006.01)

(52) U.S. Cl. ..... 235/487

(58) Field of Classification Search ..... 235/487, 235/492

See application file for complete search history.

(56) References Cited

U.S. PATENT DOCUMENTS

| | | | | |
|---|---|---|---|---|
| 2,437,335 | A * | 3/1948 | Shapiro | 132/297 |
| 4,739,877 | A * | 4/1988 | Olson | 206/38.1 |
| 5,020,255 | A | 6/1991 | Rodel | |
| 5,740,624 | A | 4/1998 | Baseley | |
| 5,769,212 | A * | 6/1998 | Collins | 206/38 |
| 6,248,451 | B1 | 6/2001 | Smith | |
| 6,325,284 | B1 * | 12/2001 | Walker et al. | 235/380 |
| 7,156,301 | B1 * | 1/2007 | Bonalle et al. | 235/380 |
| 2004/0169088 | A1 * | 9/2004 | Nelms et al. | 235/493 |
| 2006/0273178 | A1 * | 12/2006 | Tsang | 235/487 |

* cited by examiner

*Primary Examiner*—Daniel Stcyr

(57) ABSTRACT

A key ring card wallet for holding key ring cards such as club membership cards, shopping club cards, and small credit cards is made of a front sheet, a back sheet, and the sheets are connected by a folding line, a seam or a hinge. Each of the sheets has means for fastening itself to the other. Upon being folded along the fold line, the two sheets form a jacket for holding the cards inside and also provide a common hole through which a key ring passes. In such a key ring card and wallet assembly, each of the key ring cards is allowed to rotate around the loop of the key ring so that the key ring cards can get out of or retract into the jacket. Key ring cards can be added or removed from the assembly without removing the wallet from the key ring.

20 Claims, 8 Drawing Sheets

KEY RING CARD WALLET

REFERENCE TO RELATED APPLICATIONS

The present application is a continuation application of the U.S. patent application Ser. No. 10/336,947, filed Jan. 6, 2003 now abandoned with inventor Bradley L. Lambright and entitled "Key ring card wallet", which claims the priority from the provisional application Ser. No. 60/348,058 accorded with a filing date of Jan. 11, 2002.

FIELD OF INVENTION

A key ring wallet is a protective device that can be used to hold a variety of things such as key ring identification cards, security keys, credit cards, and keys that are connected to a key ring.

BACKGROUND OF THE INVENTION

In recent years, key ring cards, such as the key ring element in U.S. Pat. No. 5,495,981 issued on Mar. 5, 1996 to Warther for a transaction card mailer and method of making, were introduced by grocery stores, health clubs and other establishments to register and identify their patrons. Also, Discover has introduced a small credit card. Before long, an individual may have many of these cards dangling from his/her key ring. The cards, which are unprotected, may be subject to a variety of wears and tears when the keys are thrown onto tables or other objects, or are placed in pockets and taken out of pockets. Moreover, the sharp metal teeth of the keys and other sharp instruments such as small knights on a key ring are capable of damaging the media containing barcodes and identification information. As a result, the cards may become unreadable. This unsolved problem may cause people to avoid using key ring cards and discourage banks from introducing smaller and more convenient credit cards that go with key rings.

Many wallets, pouches and similar containers for standard wallet size and other sizes of identification cards are available. Examples are U.S. Pat. No. 4,739,877 issued on Apr. 26, 1988 to Olson for a combination key ring and card holder, U.S. Pat. No. 5,740,624 issued on Apr. 21, 1998 to Baseley for an identification card holder, and U.S. Pat. No. 6,248,451 issued on Jun. 19, 2001 to Smith for a leather surround for decorative articles. None of those patents, which are not admitted as prior art of this invention by its mention here, seem to teach a method for making a key ring wallet for protecting key ring cards. Similarly, a jacket-like container, which is not admitted as analogous art of this invention by its mention here, was available for holding a car key. None of those wallets, pouches or containers disclosed in patents or seen in public use is suitable for protecting key ring cards.

For the foregoing reasons, there is a need for some protective device for the key ring cards, and there is a need for some key ring card protective device that can be made inexpensively, and there is a need for a method that can be used to protect key ring cards without adding significant inconvenience to the users.

SUMMARY OF THE INVENTION

The key ring card wallet according to the present invention is directed to a protective jacket for holding and protecting at least one key ring card. Thus, one aspect of the present invention is to provide a key ring card wallet having a protective jacket, which can enclose at least one key ring card, while both the jacket and the key ring cards are removably connected to a key ring.

This aspect and other aspects of the present invention will become apparent to those skilled in the art after a reading of the following detailed description of the invention together with the following drawings.

It is to be understood that both the foregoing general description and the following detailed description are exemplary and are intended to provide further explanation of the invention as claimed.

DETAILED DESCRIPTION OF THE INVENTION

All illustrations of the drawings are for the purpose of describing selected versions of the present invention and are not intended to limit the scope of the present invention. Key ring element means anything that is attached to a key ring or an equivalent loop through its hole or an extension loop. Examples are club identification cards, grocery store bonus cards, health club identification cards, magnetic security keys (such as Kastle Systems keys), small knights, conventional keys, and other traveling utilities securely and removably attached to a key ring or an equivalent loop. When reference is made to key ring card(s), a single form may mean both single and plural forms while a plural form may mean both plural and single forms. When reference is made to sheets, sheet may mean a member of a sheet or a complete sheet, depending upon its context. Locking mechanism means, all fastening devices or fasteners, and all mechanisms that can be used to keep two pieces together as it is used in covers and containers. The above definitions are generally applied in the following description and the appended claims unless the languages where they appear modify their meanings.

The present invention provides a key ring card wallet, which combines a key ring and a wallet-type protective jacket for holding and protecting at least one key ring card. The key ring provides a releasable securement or holder for the key ring cards while the jacket may be kept closed by a locking means or releasably fastened by a fastening device.

The key ring cards and at least one side of the jacket include a hole, which threads onto the key ring that holds the key ring cards, permitting the key ring cards to rotate on the same axis formed by the key ring and also permitting the cards to be rotated out of the jacket for use. Key ring cards can be added or removed from the key ring without removing the jacket.

Figure 1:
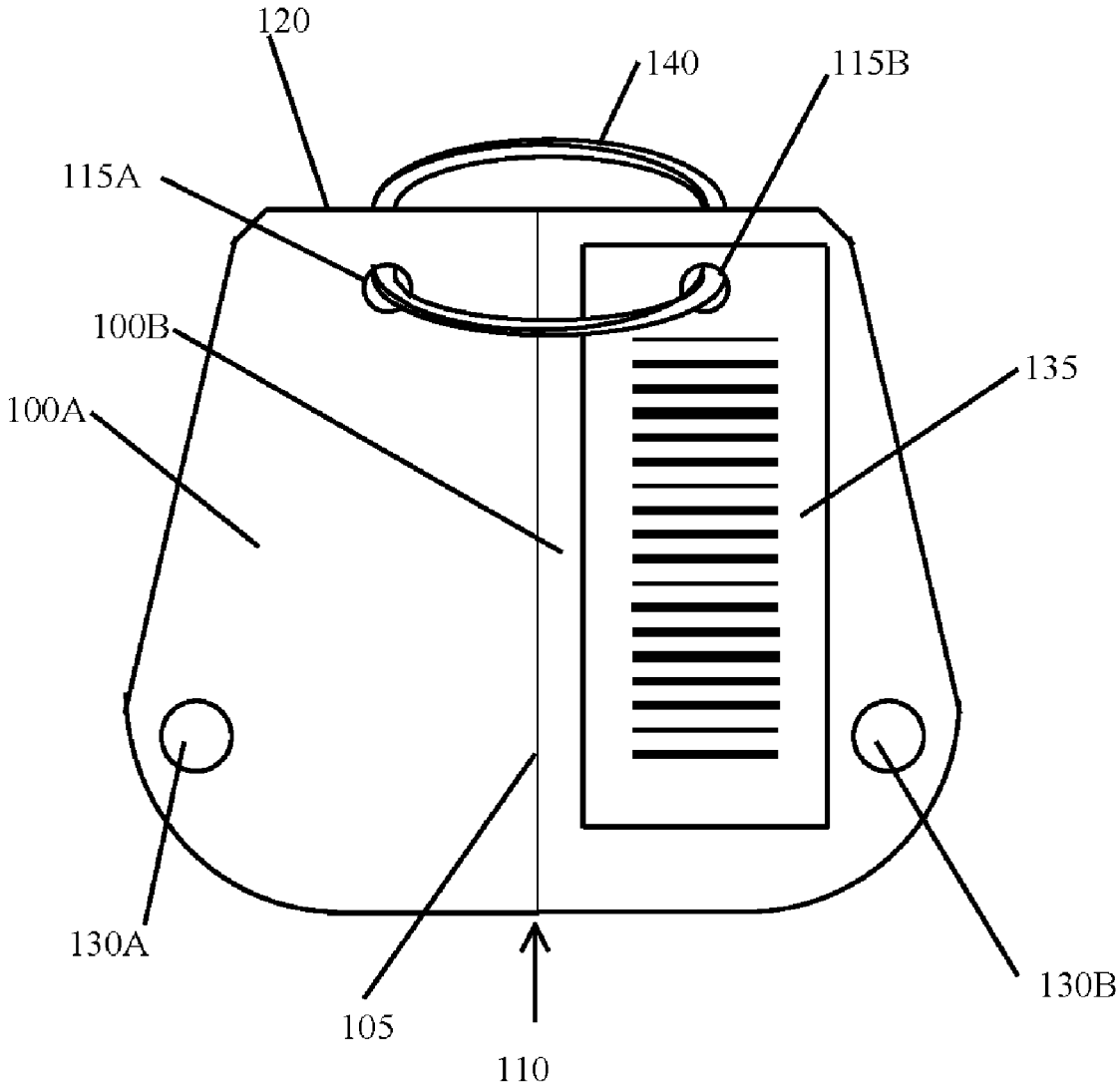
FIG. 1 is an inside view of a key ring card wallet in an open position embodying some features of the present invention.
Figure 2:
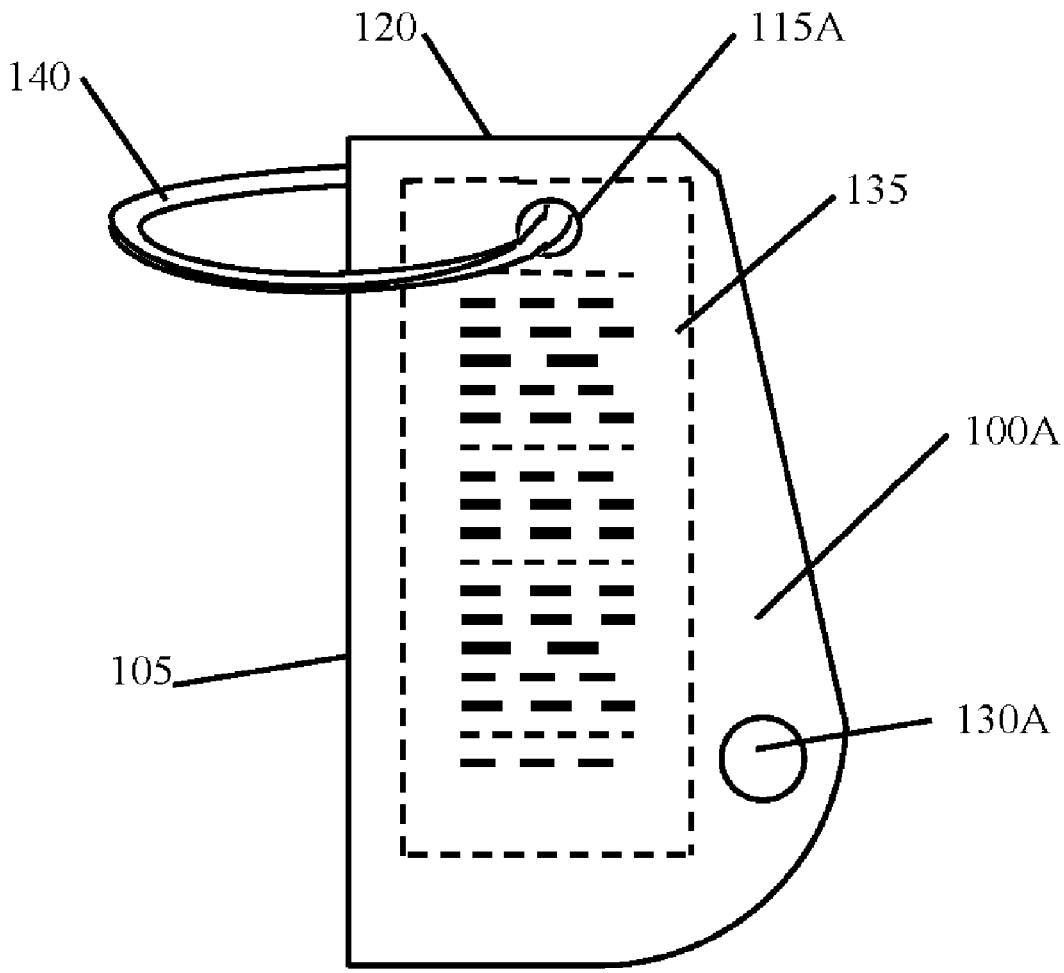
FIG. 2 is a front view of the key ring card wallet of FIG. 1 in a closed position.
Figure 3:
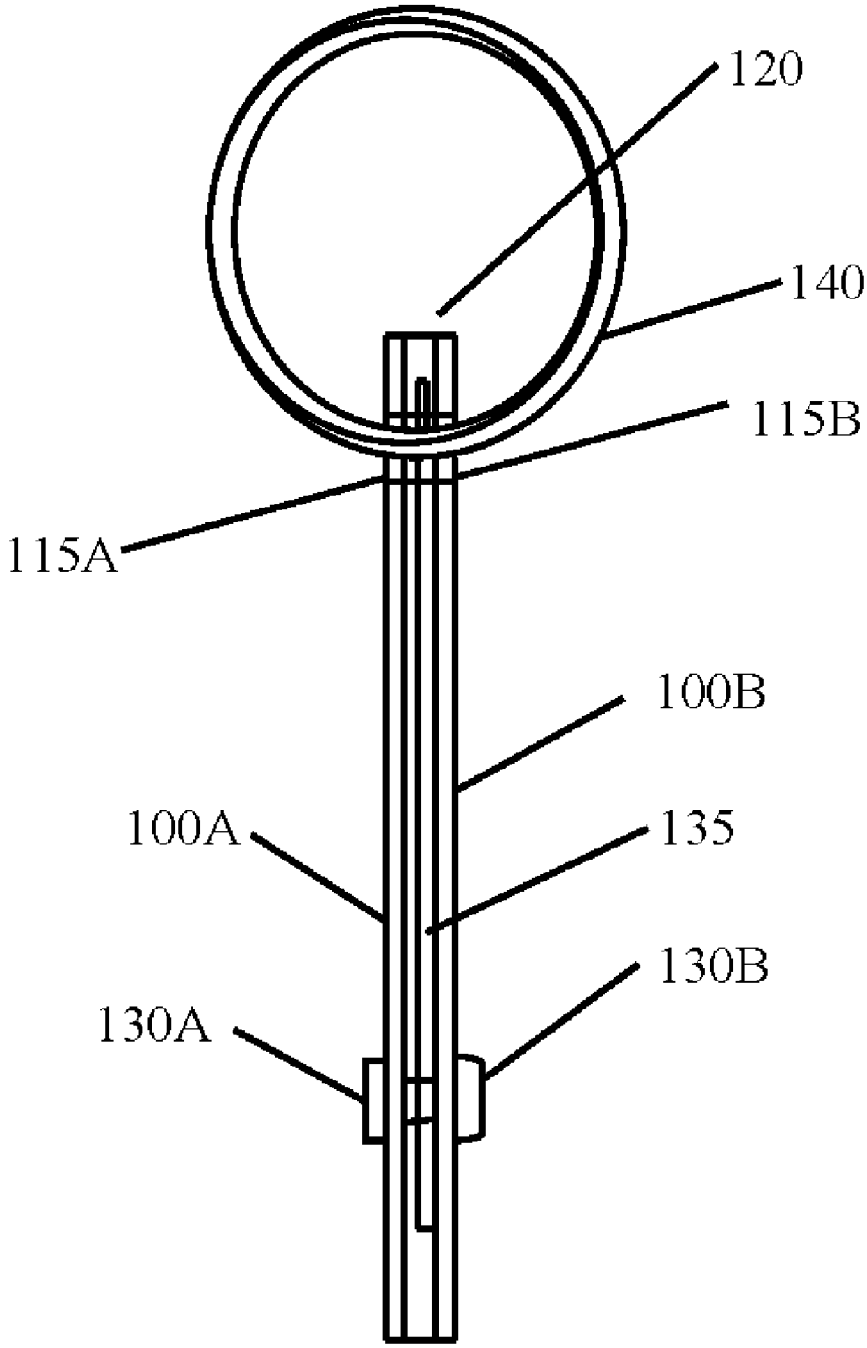
FIG. 3 is a cut-away front view of the key ring card wallet of FIG. 2 in a closed position.

In the first embodiment of the present invention shown in FIG. 1, the key ring card wallet comprises a sheet 100A, a sheet 100B, and a folding mechanism 105 that joins the sheets 100A and 100B along the fold line 110 of the folding mechanism 105. The sheets 100A and 100B have holes 115A and 115B near the common top edge 120 that crosses the fold line 110, and a fastening device 125 having fastening component 130A and a fastening component 130B anywhere along the two edges that are away from and most closely parallel to the fold line 110. After the sheet 100A is folded onto the sheet 100B to form a jacket along the fold line 110 for holding a plurality of key ring cards 135, the key ring 140 passes through the holes 115A and 115B.

The sheets 100A and 100B should have suitable sizes and shapes so that the jacket formed by the sheets 100A and 100B upon being folded should be sufficiently large to cover up most of the surfaces of the key ring cards 135. When the sheets 100A and 100B are on a plane, the holes 115A and 115B are approximately symmetrical to each other in their positions with respect to the fold line 110. When the sheet 100A is folded onto the sheet 100B, the holes 115A and 115B are approximately aligned so that the key ring 140 can pass through them without distorting the jacket. Likewise, the fastening components 130A and 130B are substantially symmetrical to each other in their positions with respect to the fold line 110 so that they can be engaged to each other to keep the wallet closed without causing significant distortions to the jacket. If a particular type of fastening devices such as Velcro does not share a common axis when they are engaged, the two components of the fastening device 125 are placed in two respective suitable positions so that they, upon being engaged, do not twist the jacket.

Figure 4:
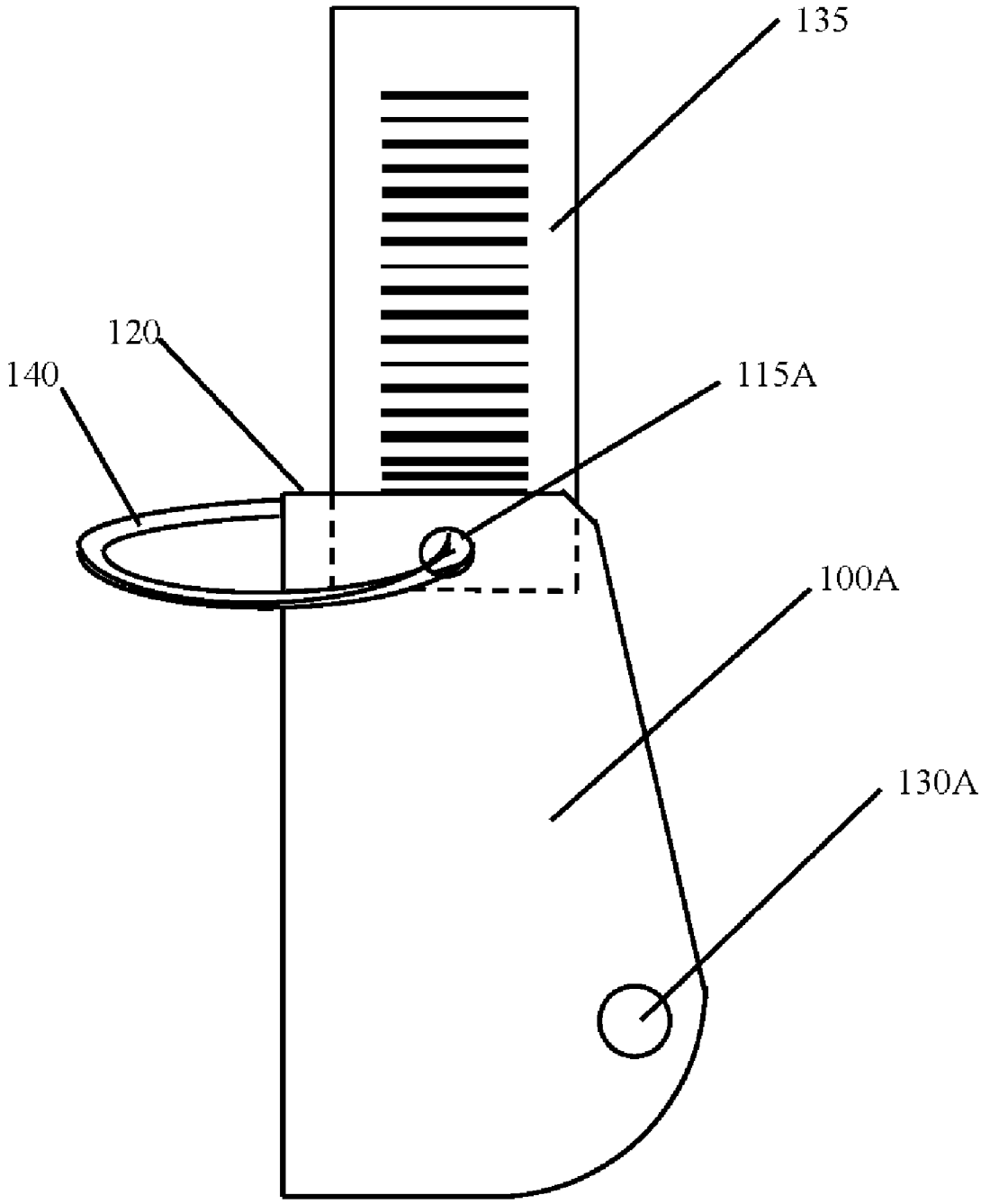
FIG. 4 is a front view of the key ring card wallet of FIG. 2 with a key ring card shown in a position for use.

Preferably, the area between the holes 115A and 115B and the common top edge 120 is small enough to allow visible access to the identification information on any one of the key ring cards 135 when it is rotated around the loop of the key ring 140 to get out of the jacket while it remains securely connected on the key ring 140. The key ring cards 135 and their media are illustrated in FIG. 4 to show their use according to the present invention. Various sizes of the key rings 140 may be used with the present invention.

The jacket of the key ring wallet can be made in any size necessary to accommodate the various sizes of the key ring cards 135. While the shapes of the sheets 100A and 100B shown in FIG. 1 are preferred for supermarket key ring cards because they are normally rectangular, they may have any shape suitable for the cards to be held. The jacket may be sized for larger key ring cards such as identification cards and health club cards, which may be close to standard credit cards in size and which may have different shapes and/or cutouts. While it is preferred for the jacket to cover up all areas of the key ring cards 135 containing the identification information and barcodes, it is not required to cover them up completely. The three non-folding edges of the sheets 100A and 100B do not need to be symmetrical along the fold line 110. Exposure of part of the edges of the key ring cards 135 may provide design deviations. The sheets 100A and 100B may be different in both size and shape as long as they, upon being folded together to form a jacket, have a common through-hole for the key ring 140 and allow the fastening components 130A and 130B to engage without materially distorting the jacket. All of the three edges of the jacket may have various shapes. The common top edge does not have to be in a straight line.

The key ring 140 is preferentially of a conventional circular type although it may have circular or any non-circular loop structure. Examples include split flat spiral conventional key rings, oval key rings, triangular loops, and rectangular loops, and their equivalents.

The sheets 100A and 100B may be of any material that can protect the key ring cards 135 against wears and tears. They may optionally be water resistant. The choices of the material may include, but not limited to, any suitable synthetic materials such as latex, nylon, polyester, vinyl resin, polyethylene and plastic and materials of natural sources such as leather, suede, rubber, cotton, and silk. The sheets 100A and 100B may be made of a combination of synthetic and natural materials. The sheets 100A and 100B may be of woven type or non-woven type. If the sheets 100A and 100B are fairly rigid, it is preferable to have a soft sheet as the folding mechanism 105 connecting the sheets 100A and 100B. If the sheets 100A and 100B are made of hard materials such as sheet metals, the sheets 100A and 100B need to be joined by a more flexible strip forming a seam, which allows the sheets 100A and 100B to easily slide along the key ring 140. Generally, suitable materials include any other material now existing or developed in the future as long as it can form a sheet structure that has fair tensile strength and reasonable durability. Plastics, rubbers and other synthetic materials may be made into thin sheets by injection molding and/or other process.

The sheets 100A and 100B may be made of different materials or comprise multiple layers of sub-sheets. Combination materials may be used in the key ring card wallet to achieve different colors, looks, and hand feels, to satisfy personal preferences, to reduce costs of manufacture, to increase durability and improve its suitability for use under different environmental conditions. For example, the sheet 100A may be made of one material while the sheet 100B is made of another material. In this case, the folding mechanism 105 may be just a seam formed by the sheets 100A and 100B. The seam is formed by stitching two pieces of sheet materials together as it is well known in the art. In addition, the sheets 100A and 100B may have multiple layers of the sheet material or comprise a plurality of sub-sheets. Also, a great number of possible features such as transparent card pockets and magnetic money clips may be added to the interior or exterior of the jacket.

The material used for the sheets 100A and 100B may provide stiffness that aides in protecting the cards contained therein. When the material used is soft or extensible, the key ring cards 135 inside the jacket may help it maintain its shape, especially when the jacket is held in a closed position.

Depending upon the specific type of material selected for the sheets 100A and 100B, if the material is not sufficiently durable to withstand the wears and tears arising from frequent handling to which the key ring 140 is normally subjected, grommets can be installed in the holes 115A and 115B. If this is not possible with the material in use, it is less durable. If the information-containing media of the key ring card 135 is next to its mounting hole, the wallet maintains most of its functions except that the wallet will need to be in an open position when one of the key ring cards 135 is read or scanned.

Any fastening devices may be used for maintaining the jacket in a closed position. Many fastening devices have female-and-male components, which can engage to effectuate fastening function. When the fastening device 125 is selected and installed on the wallet, the fastening component 130A should be able to engage to the fastening component 130B. The fastening components 130A and 130B may be substantially equivalent to each other as in the case of zipper. Other suitable fastening devices include snap fasteners, glove fasteners, plastic snaps, button, buckle, hook-and-eye, toggle, clasp, and Velcro. The fastening device 125 is intended to encompass within the language any structure presently existing or developed in the future that performs fastening function. Glove fasteners are preferred because it is the most convenient for a user to open and close the jacket with glove fasteners. Generally, only one fastening device is installed on the key ring wallet although plural fastening devices may be used.

Figure 5:
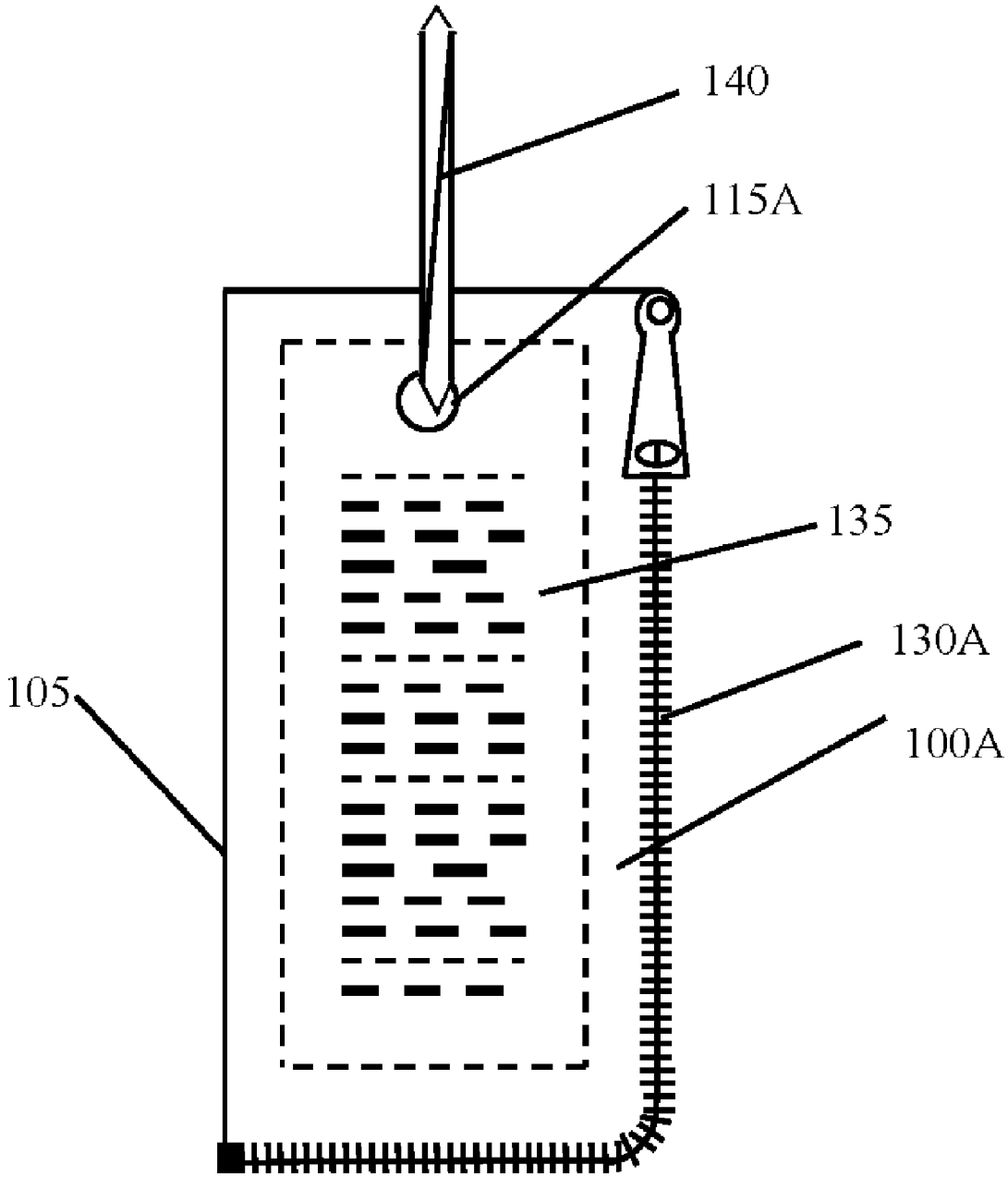
FIG. 5 is a version of a key ring card wallet containing a zipper for closure according to the present invention.

Many commercial leather shops and craft stores have the fasteners and the anvil kit for installing them. When a fastening device of a female-and-male type is used, the male component may be installed in the sheet 100A while and the female component in the sheet 100B. Conversely, the female component may be installed in the sheet 100A while the male installed on the sheet 100B. When a zipper is used, one branch of the zipper serves as the fastening components 130A while the other acts as the fastening components 130B as shown in FIG. 5. The zipper can go around all open edges as well as act as a hinge or a plurality of hinges.

Preferably, the fastening components 130A and 130B do not infringe on the storage area for the key ring cards 135. While the fastening components 130A and 130B are shown in the preferred versions of the invention, they are not required, provided that the jacket material can maintain a substantially closed position for the protection of the key ring cards 135 without requiring releasable securement.

In this preferred embodiment, a single continuous leather sheet may be used as the sheets 100A and 100B. In this case, a member of the leather sheet or a strip abutting the sheets 100A and 100B also functions as the folding mechanism 105, thereby making it unnecessary to use a seam or hinges. Because the member of the leather sheet containing the holes 115A and 115B has high tensile strength, grommets are generally not required but are optional. A key ring wallet made of leather has good durability, attractive appearance, and comfortable feel. Multiple sheets of leather may be combined in various ways to make a key ring wallet.

Figure 6:
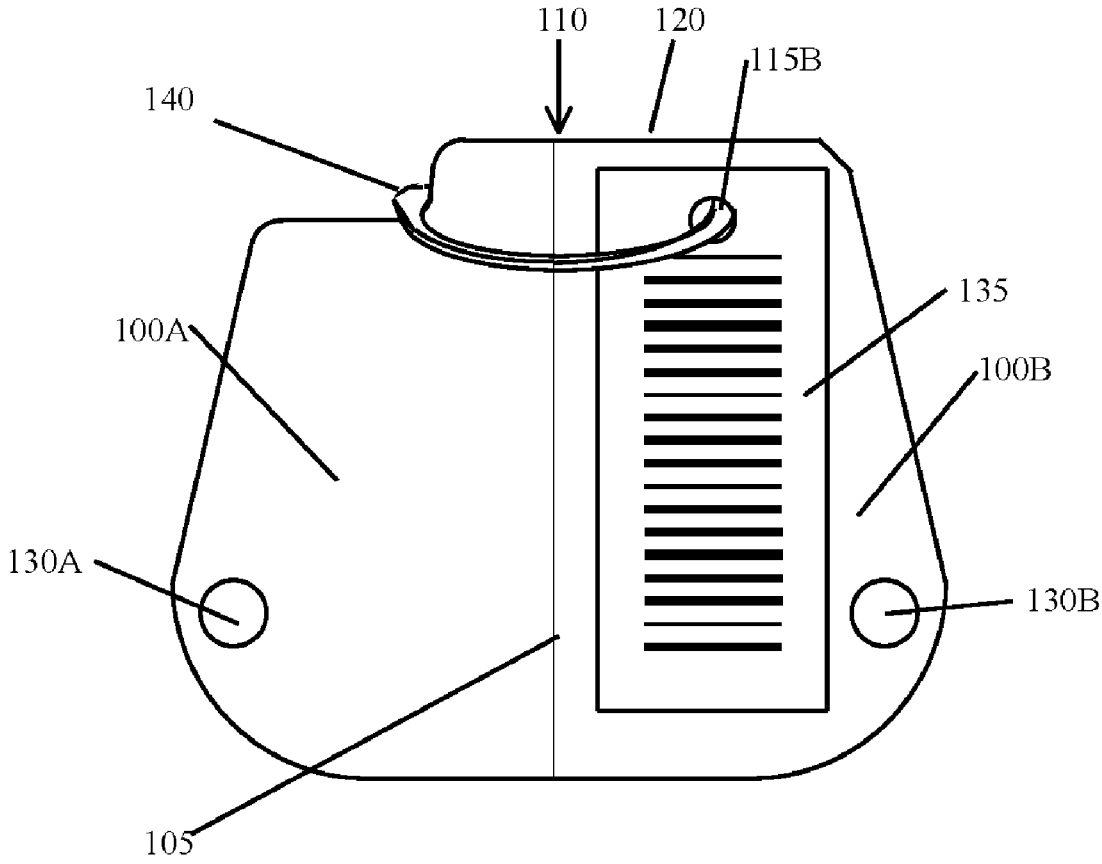
FIG. 6 is an inside view of another version of a key ring card wallet removably attached to a key ring through a single hole according to the present invention.
Figure 7:
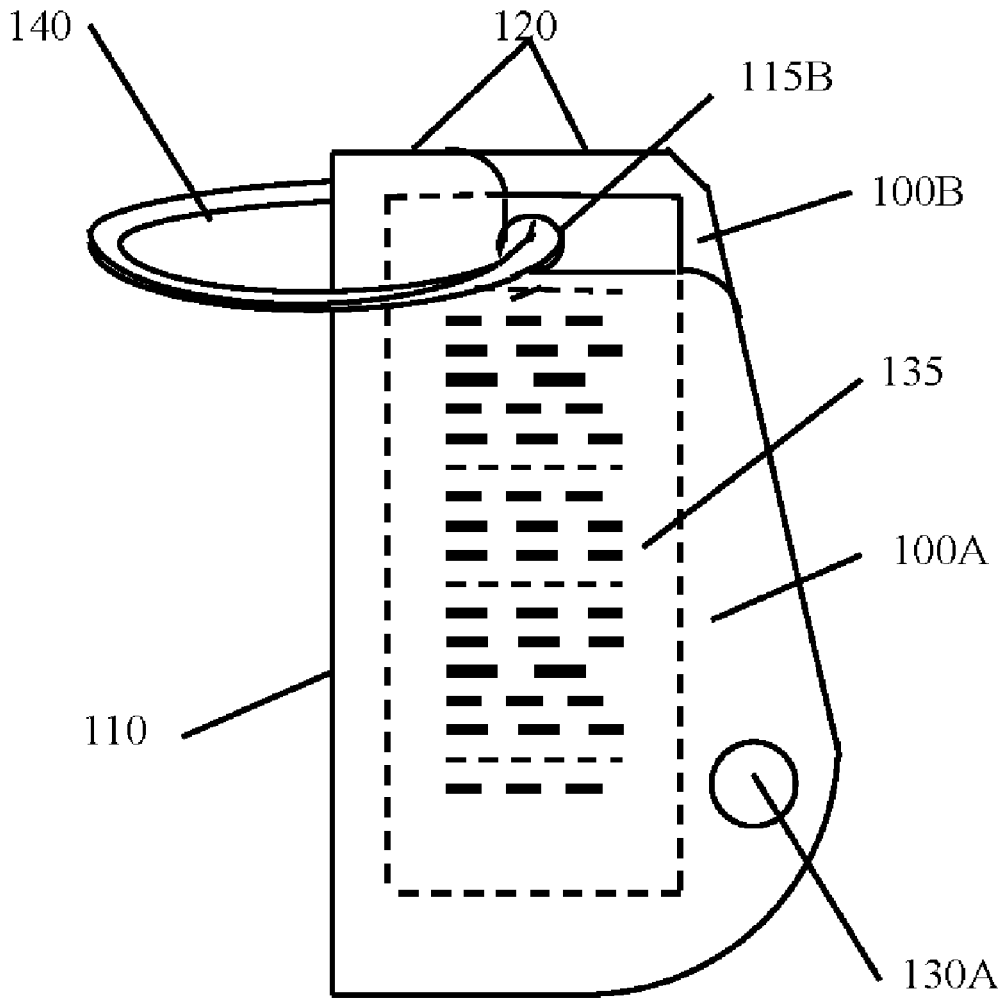
FIG. 7 is a front view of the key ring card wallet of FIG. 6 in a closed position.

Another embodiment of the present invention is shown in FIGS. 6 and 7. This key-ring wallet has all characters and features shown in FIG. 1 except that the sheets 100A and 100B have different sizes and shapes near the common top edge 120. Only one of the sheets 100A and 100B provides a hole through which the key ring 140 passes. Accordingly, the symmetrical requirement for the positions of the holes 115A and 115B is not applicable to this embodiment of a key ring wallet. While this embodiment provides less protection for the key ring cards 135, it is more convenient to use. All variations discussed for the embodiment shown in FIG. 1 regarding general features and constrains, sheet sizes and shapes, materials, fastening devices, and key rings are applicable to this embodiment. All other details discussed for the first embodiment are incorporated herein as if fully set forth for this embodiment of the invention.

Optionally, sheets 100A and 100B may be made of one or more materials such as plastic, copper, steel, and other metals. In this case, the folding mechanism 105 needs to be a flexible strip or a foldable seam that joins sheets 100A and 100B. The fastening components 130A and 130B may be installed anywhere along the two edges, which are away from and most closely parallel to the fold line 110.

Figure 8:
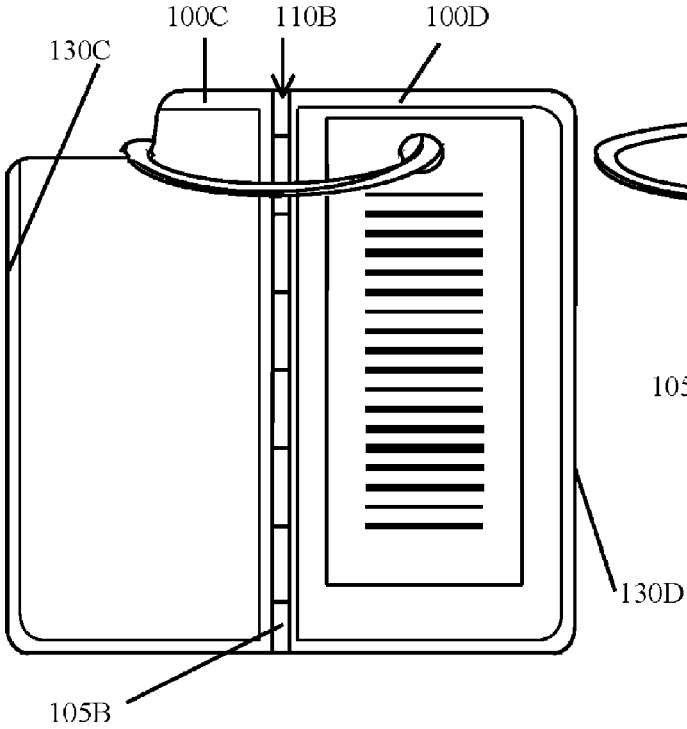
FIG. 8 is an inside view of a version of a key ring card wallet containing hinges according to the present invention.
Figure 9:
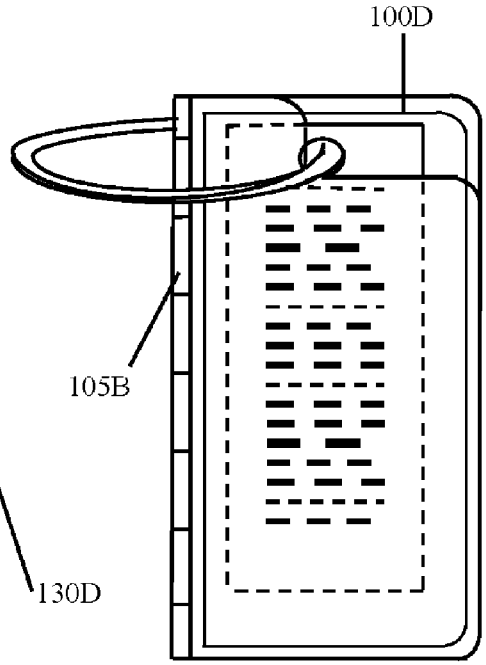
FIG. 9 is a front view of the key ring card wallet of FIG. 8 in a closed position.
Figure 10:
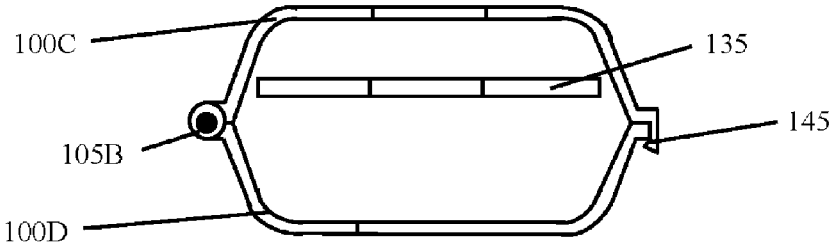
FIG. 10 is a cross-section view of the key ring card wallet of FIG. 8 in a closed position.

A third embodiment of the present invention is shown in FIGS. 8, 9, and 10. This key ring card wallet comprises a sheet 100C, a sheet 100D, and a folding mechanism 105B that joins the sheets 100C and 100D so that they can be folded together along the fold line 110B. The sheets 100C and 100D are of one or more rigid materials such as plastic, copper, steel, and other metals. One of the sheets 100C and 100D has extra area sufficiently large for containing a hole at one of the ends along the fold line 110B. In addition, it has a locking mechanism 145, which maintains the jacket in a closed state, as shown in FIG. 10.

It is preferable for the sheets 100C and 100D to have pan-like shapes, with their bottoms being away from each other so that the jacket, upon being closed, looks like an eyeglass case as shown in FIG. 10. In this situation, the sheet 100C may be referred to as case while the sheet 100D may be referred to as cover. This feature is necessary for the key ring wallet to hold a plurality of the key ring cards 135.

Optionally, the folding mechanism 105B may be one or more hinges or anything that functions like a hinge. The locking mechanism 145 is a snap-like device or a friction grip shown in FIG. 10 or any other locking mechanism commonly used to engage covers to their containers. The locking mechanism 145 normally comprises components 130C and 130D. One of the components is on the sheet 100C and while the other on the sheet 100D. The two components can engage with a certain degree of precision, and prevent the sheet 100C and 100D from moving apart by relative friction or a barb on one of the components. If the folding mechanism 105B is one or more hinges that connect the sheets 100C and 100D, the locking mechanism 145 may be a spring installed along the hinge axis with two ends attaching to the sheets 100C and 100D with a load force in favor of closure of the jacket.

Key ring card wallets according to the present invention are made by cutting the material, in particular leather and suede, in the general shape as shown in FIG. 1 using a knife or scissors; a punch or die cutter may also be used for large-scale manufacturing. Leather hole punches are used to punch out the holes for the key ring 140 and the snaps. A clicker or die made to cut material such as these can be made to facilitate consistent manufacture, i.e., cut the overall shape and punch the holes 115A and 115B. Ornaments, fashion logos, leather stamps and the like can be added to the outside of the wallet to enhance its appearance and to provide for logos or other identification so that it may be employed for marketing purposes.

The key ring cards 135 can be threaded onto the key ring 140 with the wallet in an open position, as shown in FIGS. 1 and 6. Alternatively, the key ring cards 135 are placed in the jacket in proper alignment and then the entire jacket and key-ring-card assembly is threaded onto the key ring 140. To use one particular card, the user merely needs to unfasten the wallet and rotate the card out of the jacket. The card can be rotated back into the wallet for storage, and the wallet can then be refastened. The wallet can also be refastened with the card out as shown in FIG. 4 to minimize damage and visibility of other cards.

While the invention was primarily intended for holding key ring cards, its use is not so limited. It is apparent that such a wallet may be used to store other items. It may be used to hold keys to prevent them from damaging the pockets of expensive clothing.

In those exemplary embodiments of the invention, specific components, arrangements, and assemble processes are used to describe the invention. Obvious changes, modifications, and substitutions may be made by those skilled in the art to achieve the same purpose of this invention. The exemplary embodiments are, of course, merely examples and are not intended to limit the scope of the invention. It is intended that the present invention cover all other embodiments that are within the scope of the appended claims and their equivalents.

What is claimed is:

1. A key ring card wallet for holding plural key ring cards comprising:

a plurality of the key ring cards, each having a hole at an end;

a jacket containing a first sheet, a second sheet and a fold line joining the first sheet and the second sheet, the size and shape of the jacket being comparable to the key ring cards;

a hole being situated near the end of each of the two sheets of the jacket, the two holes being substantially aligned when the two sheets are folded together along the fold line;

fastening means having a first component and a second component, the first component being installed near the side edge of the first sheet, and the second component being installed near the side edge of the second sheet so that they are allowed to engage with each other when the two sheet are folded together; and a key ring threading through the first sheet, the key ring cards, and the second sheet so that the key ring cards are within the jacket formed by the two sheets, the key ring and the fastening means.

2. The key ring card wallet of claim 1 wherein the sheets is made of flexible material selected from the group consisting of leather, suede, nylon, polyester, vinyl resin, polyethylene, rubber, plastics, cotton, and silk.

3. The key ring card wallet of claim 2 wherein the fastening means is a device is selected from the group consisting of snap fasteners, glove fasteners, plastic snaps, button, buckle, hook-and-eye, toggle, clasp, Velcro and zipper.

4. The key ring card wallet of claim 2 wherein the holes are strengthened by rivets to improve durability.

5. The key ring card wallet of claim 1 wherein the fastening means is a device is selected from the group consisting of snap fasteners, glove fasteners, plastic snaps, button, buckle, hook-and-eye, toggle, clasp, Velcro and zipper.

6. The key ring card wallet of claim 5 wherein the holes are strengthened by rivets to improve the durability.

7. The key ring card wallet of claim 1 wherein the holes are strengthened by rivets to improve the durability.

8. A key ring card wallet for holding plural key ring cards comprising:

a jacket containing a first sheet, a second sheet and a fold line joining the first sheet and the second sheet, the size and shape of the jacket being comparable to the key ring cards;

a hole being located near the end of the first sheet, the second sheet having a cutout so that the second sheet will not cover up the hole in the first sheet when the two sheets are folded together along the fold line;

fastening means having a first component and a second component, the first component being installed on the first sheet and the second component being installed on the second sheet so that they are allowed to engage with each other when the two sheets are folded together; and a key ring threading through the first sheet and the key ring cards so that the second sheet is allowed to wrap around the key ring cards.

9. The key ring card wallet of claim 8 wherein the first sheet and the second sheet are made of flexible material selected from the group consisting of leather, suede, nylon, polyester, vinyl resin, polyethylene, rubber, plastics, cotton, and silk.

10. The key ring card wallet of claim 9 wherein the fastening means is a device is selected from the group consisting of snap fasteners, glove fasteners, plastic snaps, button, buckle, hook-and-eye, toggle, clasp, Velcro and zipper.

11. The key ring card wallet of claim 9 wherein the holes are strengthened by rivets to improve the durability.

12. The key ring card wallet of claim 8 wherein the fastening means is a device is selected from the group consisting of snap fasteners, glove fasteners, plastic snaps, button, buckle, hook-and-eye, toggle, clasp, Velcro and zipper.

13. The key ring card wallet of claim 12 wherein the holes are strengthened by rivets to improve the durability.

14. The key ring card wallet of claim 8 wherein the holes are strengthened by rivets to improve the durability.

15. The key ring card wallet of claim 8 wherein the first sheet and the second sheet are made of different materials.

16. A key ring card wallet for holding plural key ring cards comprising:

a case having a pan-like structure and being comparable to the key ring cards in size and shape;

a hole being situated at one end of the case for attaching a key ring;

a cover for the case with a cutout at an end;

folding mechanism connecting the case and the cover so that the cover may have an open or closed position and the cutout of the cover is aligned with the hole of the case; and locking mechanism having a first component and a second component, the first component being installed in the case near the side edge opposite to the folding mechanism, the second component being installed in the cover near the side edge opposite to the folding mechanism so that they are allowed to engage with each other when the cover is in the closed position.

17. The key ring card wallet of claim 16 wherein the case and the cover are made of metals or other non-flexible materials; and wherein the locking mechanism is a friction grip, with one component in the case and the other component in the cover.

18. The key ring card wallet of claim 16 wherein the cover has a pan-like structure.

19. The key ring card wallet of claim 16 wherein the folding mechanism is a pair of hinges.

20. The key ring card wallet of claim 16 further comprising a key ring being removably attached to the key ring wallet through the hole.

* * * * *